United States Patent [19]

Takeuchi et al.

[11] Patent Number: 4,767,944

[45] Date of Patent: Aug. 30, 1988

[54] HYBRID RELAY CIRCUIT HAVING ELECTROMAGNETIC RELAY FOR SWITCHING AC POWER SUPPLY

[75] Inventors: Hiroto Takeuchi, Komoro; Masahiro Hishimura, Saku, both of Japan

[73] Assignee: Takamisawa Electric Co., Ltd., Tokyo, Japan

[21] Appl. No.: 75,272

[22] Filed: Jul. 20, 1987

Related U.S. Application Data

[63] Continuation of Ser. No. 830,790, Feb. 19, 1986, abandoned.

[30] Foreign Application Priority Data

| | | | |
|---|---|---|---|
| Feb. 20, 1985 | [JP] | Japan | 60-030498 |
| Jul. 24, 1985 | [JP] | Japan | 60-161784 |
| Jul. 24, 1985 | [JP] | Japan | 60-161785 |
| Jul. 24, 1985 | [JP] | Japan | 60-161786 |

[51] Int. Cl.[4] ..... H01H 47/32

[52] U.S. Cl. ..... 307/132 E; 323/235; 323/319; 361/185; 361/7

[58] Field of Search ..... 307/132 E, 134, 135, 307/137; 323/235, 300, 319; 361/160, 185, 190, 2, 3, 6, 7

[56] References Cited

U.S. PATENT DOCUMENTS

| | | | |
|---|---|---|---|
| 3,883,782 | 5/1975 | Beckwith | 307/252 B |
| 3,935,482 | 1/1976 | Fox et al. | 307/252 B |
| 4,024,457 | 5/1977 | Riddle | 323/319 |
| 4,153,870 | 5/1979 | Sidman | 323/319 |
| 4,158,150 | 6/1979 | Dever | 323/319 |
| 4,174,496 | 11/1979 | McFall et al. | 323/235 |
| 4,287,468 | 9/1981 | Sherman | 323/319 |
| 4,370,564 | 1/1983 | Matsushita | 323/319 |
| 4,466,038 | 8/1984 | Robertson | 307/134 |

FOREIGN PATENT DOCUMENTS 59-29975 7/1984 Japan .

*Primary Examiner*—Patrick R. Salce
*Assistant Examiner*—Jeffrey Starrett
*Attorney, Agent, or Firm*—Armstrong, Nikaido, Marmelstein & Kubovcik

[57] ABSTRACT

In a hybrid relay circuit for supplying current to a load with a AC power supply, an electromagnetic relay is provided and the contact thereof is connected in series to the load and the AC power. The electromagnetic relay is driven by a driving circuit in accordance with an input control signal, thereby switching the supply of current to the load.

22 Claims, 8 Drawing Sheets

HYBRID RELAY CIRCUIT HAVING ELECTROMAGNETIC RELAY FOR SWITCHING AC POWER SUPPLY

This application is a continuation of application Ser. No. 830,790, filed Feb. 19, 1986, now abandoned.

BACKGROUND OF THE INVENTION (1) Field of the Invention

The present invention relates to a hybrid relay circuit for switching an AC power supply applied to a load.

(2) Description of the Related Art

Generally, solid state relay circuits have been used for switching an AC power supply applied to a load such as a motor, a signal lamp, an electromagnetic valve (solenoid valve), and the like, which requires a high frequency operation. However, since the above-mentioned solid state relay circuit includes a bidirectional thyristor, it has the following disadvantages:

(1) Due to the peculiar characteristics of the bidirectional thyristor, a reduction of potential of about 1 to 2 Vrms is generated therein, and as a result, when a load current flows through the bidirectional thyristor, a large amount of heat is generated therefrom. Thus, it is difficult to reduce the size of the solid state relay circuit, and as occasion demands, a heat dissipation plate or the like is required.

(2) The bidirectional thyristor has a high cost, thereby increasing the manufacturing cost of the solid state relay circuit.

(3) Since the bidirectional thyristor is weak against surge voltage, it may be erroneously operated or easily broken due to such surge voltage.

(4) When the bidirectional thyristor is turned on, noise is always generated, which may affect the operation of other circuits.

SUMMARY OF THE INVENTION

It is an object of the present invention to provide a hybrid relay circuit for switching an AC power supply applied to a load. The hybrid relay circuit according to the present invention comprises an electromagnetic relay having a contact connected in series to the load and the AC power supply. The potential reduction due to the turning on of the contact is very small, and the heat generated therefrom is also very small, thus the size of the hybrid relay circuit can be reduced. Also, the electromagnetic relay has a low cost, thereby reducing the manufacturing cost of the hybrid relay circuit. Further, since the electromagnetic relay is strong aginst surge voltage, the hybrid relay circuit is reliable in operation and is not broken by the surge voltage. Still further, turning-on the contact generates little noise, and accordingly, circuits other than the hybrid relay circuit may be reliably operated.

Also, in the hybrid relay circuit according to the present invention, the electromagnetic relay is turned ON or OFF when the potential of the AC power supply is almost zero. As a result, even when the electromagnetic relay is operated at a high frequency, abrasion of the contact is small, thus increasing the life term of the electromagnetic relay, i.e., the hybrid relay circuit.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Before the description of the embodiments of the present invention, a prior art solid state relay circuit will be explained with reference to FIG. 1 (see: Japanese Examined Patent Publication (Kokoku) No. 59-29975).

Figure 1:
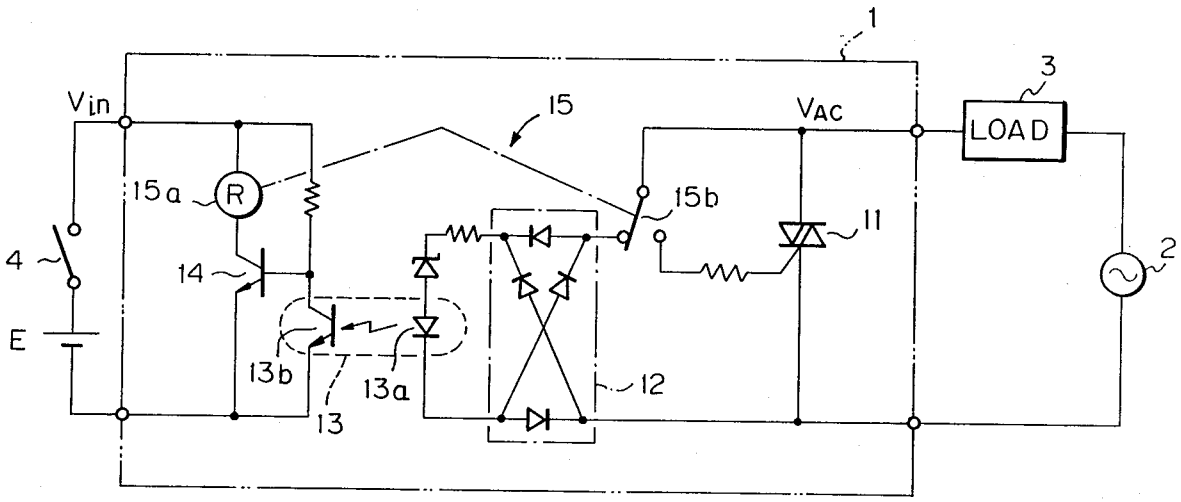
Fig. 1 PRIOR ART
FIG. 1 is a circuit diagram of a prior art solid state relay circuit for switching an AC power supply applied to a load.

In FIG. 1, a solid state relay circuit 1 switches an AC power supply 2 applied to a load 3 in accordance with an input control signal $V_{in}$ which is generated by turning ON a switch 4. The solid state relay circuit 1 comprises a bidirectional thyristor 11, a rectifier bridge circuit 12, a photocoupler 13 formed by a light emitting diode **13*a* and a phototransistor 13*b*, a transistor 14, an electromagnetic relay 15 formed by a coil 15*a* and a transfer contact 15*b***, and the like.

When the switch 4 is opened, i.e., $V_{in}$ equals E, the AC potential $V_{AC}$ between the terminals of the bidirectional thyristor 11 is rectified by the rectifier bridge circuit 12 and is then applied to and thereby drives the light emitting diode **13*a*. Therefore, the base potential of the transistor 14 is low, so that the transistor 14 remains in a non-conducting state. As a result, the electromagnetic relay 15 remains in a deactivated state so that the contact 15*b* thereof remains as indicated in FIG. 1**.

In the above-mentioned state, even when the switch 4 is turned ON, the collector potential of the phototransistor **13*b* never becomes high. That is, only when the phototransistor 13*b* is turned OFF, does the collector potential of the phototransistor 13*b* become high. Therefore, in this case, at the moment the photocoupler 13 detects a zero-phase of the AC power supply, the phototransistor 13*b* is turned OFF, and accordingly, the collector potential thereof is increased, thus turning ON the transistor 14. Thus, the electromagnetic relay 15 is activated and the contact 15*b* thereof is moved to trigger the bidirectional thyristor 11, so that current is supplied to the load 3**.

Again, when the switch 4 is turned OFF, the electromagnetic relay 15 is deactivated, so that the contact **15*b* thereof recovers its original state. Therefore, the bidirectional thyristor 11 is turned OFF, thereby shutting off the current supplied to the load 3**.

Thus, according to the circuits as illustrated in FIG. 1, the bidirectional thyristor 11 is turned ON (triggered) at a zero-phase of the AC power supply 2, but the bidirectional thyristor 11 is turned OFF regardless of the phase of the AC power supply 2.

The solid state relay circuit 1 of FIG. 1 has the disadvantages explained above, since the solid state relay circuit 1 includes the bidirectional thyristor 11.

According to the present invention, there is provided a hybrid relay circuit comprising an electromagnetic relay having a contact inserted into a circuit of the AC power supply 2 and the load 3.

Figure 2A:
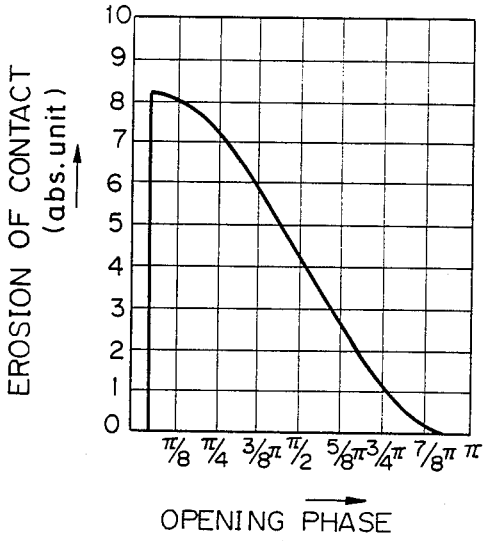
FIG. 2A is a graph showing the relationship between the opening phase of a contact of an electromagnetic relay and erosion thereof.
Figure 2B:
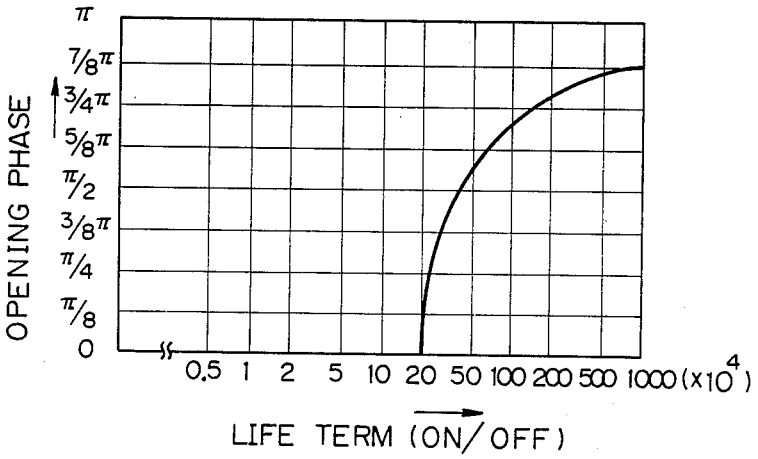
FIG. 2B is a graph showing the opening phase of a contact of an electromagnetic relay and the life term thereof.

Generally, in an electromagnetic relay circuit, the abrasion of a contact is proportional to the arc energy generated therefrom, and most of the arcing at the contact is generated at the opening of the contact. Therefore, it is sufficient to consider only the arc generated at the opening of the contact regarding the abrasion of the contact. As illustrated in FIG. 2A, which shows the relationship between the opening phase of a contact and the erosion thereof, and FIG. 2B which shows the relationship between the opening phase of a contact and the life term thereof, the abrasion of a contact becomes smaller as the opening phase approaches $7\pi/8$, and accordingly, the life term of a contact becomes longer as the opening phase approaches $7\pi/8$. For example, the life term at the opening phase of $7\pi/8$ is about twenty times the life period at the opening phase of $\pi/2$, which is considered to be an average phase when the AC power supply is randomly opened. Also, the deposition on the contact is due mainly to a rush current flowing through the load such as a motor, a signal lamp, a solenoid valve, or the like, and therefore, the deposition on the contact can be diminished by closing the contact when the rush current is zero. Further, the noise generated by opening and closing the contact can be reduced when the opening and closing of the contact is carried out near the zero phase of the AC power supply.

Figure 3:
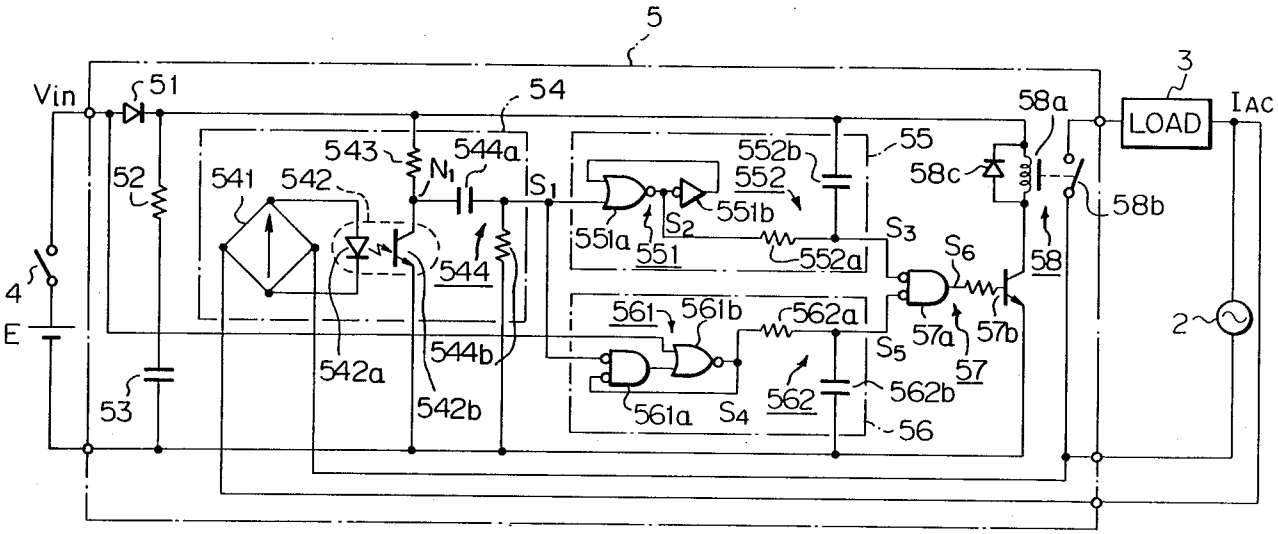
FIG. 3 is a circuit diagram illustrating a first embodiment of the hybrid relay circuit according to the present invention.

In FIG. 3, which illustrates a first embodiment of the present invention, reference numeral 5 designates a hybrid relay circuit which switches the AC power supply 2 applied to the load 3 in accordance with the input control signal $V_{in}$. The hybrid relay circuit 5 comprises: a reverse current avoiding diode 51; a current limit resistor 52; a capacitor 53; a detection circuit 54 for detecting a zero-phase of the AC power supply 2, i.e., whether the potential of the AC power supply 2 is zero; a closing timing control circuit 55, an opening timing control circuit 56; and a driving circuit for driving (activating) an electromagnetic relay 58 formed by a coil 58*a* and a contact 58*b* which is, in this case, a make contact. Also, a diode 58*c* is provided at the coil 58*a* for avoiding counter electromotive force in the coil 58*a* of the electromagnetic relay 58. Reference E designates a DC power supply.

The detection circuit 54 is connected to the terminals of the AC power supply 2, and is used for detecting a zero phase of the AC power supply 2. That is, the detection circuit 54 detects whether the potential of the AC power supply 2 is zero. The detection circuit 54 comprises a rectifier bridge circuit 541 having a pair of diagonal terminals connected to the A/C power supply 2 and a pair of diagonal terminals connected to the photocoupler 542. Also, the detection circuit 54 comprises a photocoupler 542 formed by a light emitting diode 542*a* and a phototransistor 542*b*, a load resistor 543, and a differential circuit 544 formed by a capacitor 544*a* and a resistor 544*b*. In the detection circuit 54, when the current $I_{AC}$ of the AC power supply 2 is zero, the light emitting diode 542*a* of the photocoupler 542 is cut off, thereby increasing the potential at node $N_1$. This increase of the potential at node $N_1$ is differentiated by the differential circuit 544 which generates a zero-phase detection signal $S_1$ and transmits it to both the closing timing control circuit 55 and the opening timing control circuit 56.

The closing timing control circuit 55 comprises a hold circuit 551 formed by a NOR circuit 551*a* and an inverter 551*b*, and an integration circuit 552 formed by a resistor 552*a* and a capacitor 552*b*. The hold circuit 55 holds the zero-phase detection signal $S_1$ of the detection circuit 54 after the detection circuit 54 detects a zero phase of the current $I_{AC}$ of the AC power supply 2. The output of the hold circuit 551 is delayed by the integration circuit 552, and the output $S_3$ thereof, is then supplied to the driving circuit 57.

The opening timing control circuit 56 comprises a hold circuit 561 formed by a gate circuit 561*a* and a NOR circuit 561*b*, and an integration circuit 562 formed by a resistor 562*a* and a capacitor 562*b*. The hold circuit 561 also holds the zero-phase detection signal $S_1$ of the detection circuit 54 after the detection circuit 54 detects a zero phase of the current $I_{AC}$ of the AC power supply 2. The output of the hold circuit 561 is delayed by the integration circuit 562, and the output $S_5$ thereof is then supplied to the driving circuit 57.

The driving circuit 57 comprises a gate circuit 57*a* and a transistor 57*b*. In the driving circuit 57, when the output signal $S_3$ of the closing timing control circuit 55 and the output signal $S_5$ of the opening timing control circuit 56 are both low, the output signal $S_6$ of the gate circuit 57*a* is high, thereby turning ON the transistor 57*b*, and, when at least one of the output signal $S_3$ of the closing timing control circuit 55 and the output signal $S_5$ of the opening timing control circuit 56 are high, the output signal $S_6$ of the gate circuit 57*a* is low, thereby turning OFF the transistor 57*b*.

Power is supplied to each portion of the hybrid relay circuit 5 by turning ON the switch 4, and immediately after the switch 4 is turned OFF, power is still supplied to each portion of the hybrid relay circuit 5 for a definite time period due to the presence of the capacitor 53, which serves as a voltage buffer. In addition, the opening timing control circuit 56 is operated only when the switch 4 is turned OFF. That is, when the switch 4 is turned ON, the potential at one input terminal of the NOR circuit 561*b* of the hold circuit 561 is high, and accordingly, the potential of the output signal $S_4$ thereof is low, regardless of the zero-phase detection signal $S_1$ of the detection circuit 54.

The operation of the circuit of FIG. 3 will be explained with reference to FIGS. 4A through 4I.

Figures 4A, 4B, 4C, 4D, 4E, 4F, 4G, 4H, 4I:
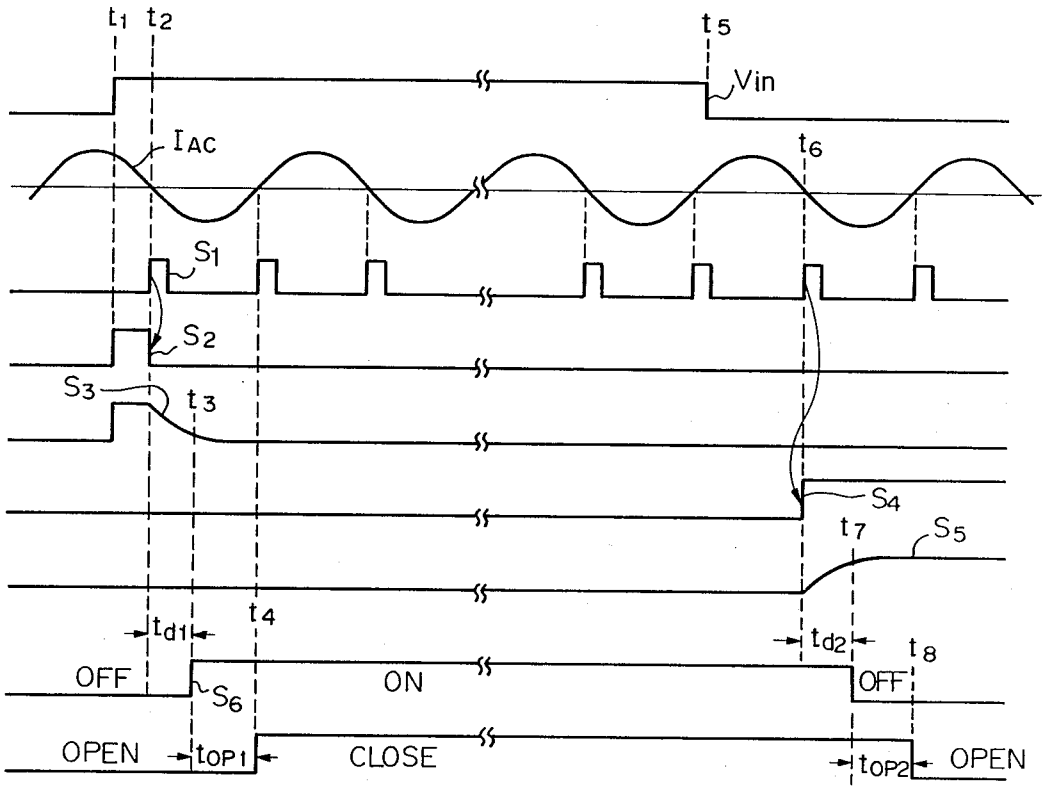
FIGS. 4A through 4I are timing diagrams showing the operation of the circuit of FIG. 3.

At time $t_1$, when the switch 4 is turned ON to increase an input voltage $V_{in}$ as illustrated in FIG. 4A, power is supplied to each portion of the hybrid relay circuit 5, thereby initiating a closing operation. That is, at time $t_1$, the hold circuit 551 and the integration circuit 552 of the closing timing control circuit 55 are activated so that their outputs $S_2$ and $S_3$ rise as shown in FIGS. 4D and 4E. Note that, in this case, even if the hold circuit 561 and the integration circuit 562 of the opening timing control circuit 56 are activated, their outputs $S_4$ and $S_5$ remain low as shown in FIGS. 4F and 4G, since the NOR circuit 561*b* is disabled by the high potential of the input voltage $V_{in}$. Also, before and after the switch 4 is turned ON, a current $I_{AC}$ flows through a closed loop formed by the AC power supply 2, the load 3, and the rectifier bridge circuit 541, as shown in FIG. 4B. Therefore, at time $t_2$, a zero-phase of the current $I_{AC}$ is detected by the detection circuit 54, and accordingly, the detection circuit 54 generates a zero-phase detection pulse $S_1$. Such a zero-phase detection pulse $S_1$ is captured by the hold circuit 551 of the closing timing control circuit 55, so that its output $S_2$ falls as shown in FIG. 4D. Note that, the output $S_2$ of the hold circuit 551 is delayed by the integration circuit 552, and accordingly, the output $S_3$ of the integration circuit 552 is gradually reduced. After a time period $t_{d1}$, i.e., at time $t_3$, when the output $S_3$ of the integration circuit 552 becomes lower than a threshold voltage of the gate circuit 56, the output $S_6$ thereof increases as shown in FIG. 4H, thereby turning ON the transistor **57*b*. As a result, at time $t_4$, the contact 58*b* of the electromagnetic relay 58 is closed, and accordingly, a large amount of current is supplied by the AC power supply 2 to the load 3. Note that an operation time period $t_{op1}$ between $t_3$ and $t_4$ is determined by the operation speed of the transistor 57*b* and the electromagnetic relay 58. In this case, according to the present invention, a delay time period (wait time period) $t_{d1}$ is adjusted by a time constant determined by the resistor 552*a* and the capacitor 552*b* of the integration circuit 552, so that the closing timing of the contact 58*b*, i.e., time $t_4$, coincides with a next zero phase of the current $I_{AC}$ of the AC power supply 2**.

Next, an opening operation will be explained below. That is, at time $t_5$, the switch 4 is turned OFF, to reduce the input voltage $V_{in}$. However, in this case, as explained above, each portion of the hybrid relay circuit 5 is still activated since power stored in the capacitor 53 is supplied thereto. Therefore, at time $t_6$, a zero-phase of the current $I_{AC}$ is detected by the detection circuit 54, and accordingly, the detection circuit 54 generates a zero-phase detection pulse $S_1$. Such a zero-phase detection pulse $S_1$ is captured by the hold circuit 561 of the opening timing control circuit 56, so that its output $S_5$ rises as shown in FIG. 4F. Then, the output $S_6$ of the hold circuit 561 is delayed by the integration circuit 562, and accordingly, the output $S_5$ of the integration circuit 552 is gradually increased. Note that, in this case, no change is generated in the closing timing circuit 55, since the operation of the hold circuit 551 thereof is fixed by itself. After a time period $t_{d2}$, i.e., at time $t_7$, when the output of the integration circuit 562 becomes higher than a threshold voltage of the gate circuit 56, the output $S_6$ thereof decreases as shown in FIG. 4H, thereby turning OFF the transistor **57*b*. As a result, at time $t_8$, the contact 58*b* of the electromagnetic relay 58 is opened, and accordingly, the large amount of current supplied by the AC power supply 2 to the load 3 is shut off. Note that an operation time period $t_{op2}$ between $t_7$ and $t_8$ is also determined by the operation speed of the transistor 57*b* and the electromagnetic relay 58. In this case, according to the present invention, a delay time period (wait time period) $t_{d2}$ is adjusted by a time constant determined by the resistor 562*a* and the capacitor 562*b* of the integration circuit 562, so that the opening timing of the contact 58*b*, i.e., time $t_8$, coincides with a next zero phase of the current $I_{AC}$ of the AC power supply 2**.

Note that in FIG. 3, the closing timing control circuit 55 can be deleted so that the contact **58*b* of the electromagnetic relay 58 is turned ON immediately after the switch 4 is turned ON. In this case, the input voltage $V_{in}$ is applied via an inverter to an input of the gate circuit 57*a*. Also, the opening timing control circuit 56 can be deleted so that the contact 58*b* of the electromagnetic relay 58 is turned OFF immediately after the switch 4 is turned OFF. In this case, the input voltage $V_{in}$ is applied via an inverter to an input of the gate circuit 57*a***.

Further, both the closing timing control circuit 55 and the opening timing control circuit 56 can be deleted so that the contact **58*b* of the electromagnetic relay 58 is turned ON and OFF immediately after the switch 4 is turned ON and OFF, respectively. In this case, the input voltage $V_{in}$ is applied via a resistor to the base of the transistor 57*b*. In a simple hybrid relay circuit having no closing and opening control circuits, since the potential reduction due to the turned-ON contact 58*b* is very small, and the heat generated therefrom is very small, the size of the hybrid relay circuit is reduced. Also, the electromagnetic relay has a low cost, thereby reducing the manufacturing cost of the hybrid relay circuit. Further, since the electromagnetic relay is strong against surge voltage, the hybrid relay is reliably operated and is not broken by the surge voltage. Still further, the turned-ON contact 58*b*** generates little noise, and accordingly, circuits other than the hybrid relay circuit may be reliably operated.

Figure 5:
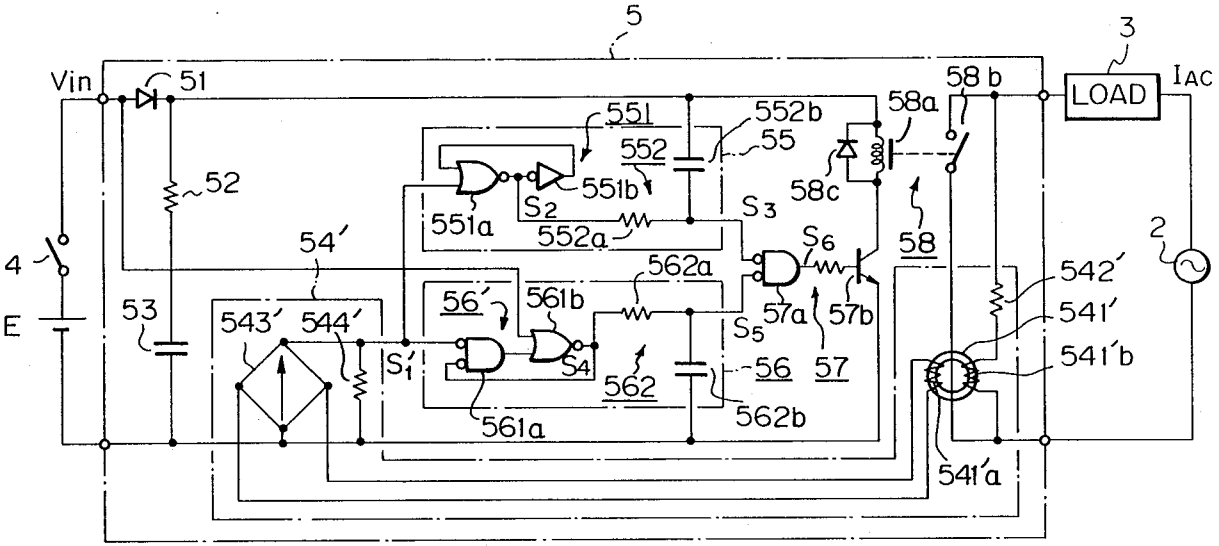
FIGS. 5, 6, 7, and 8 are circuit diagrams illustrating second, third, fourth, and fifth embodiments, respectively, of the hybrid relay circuit according to the present invention.

In FIG. 5, which illustrates a second embodiment of the present invention, a detection circuit 54' is provided instead of the detection circuit 54 of FIG. 3. The detection circuit 54' comprises a current transformer 541' having primary and secondary windings **541'*a* and 541'*b*. The secondary winding 541'*b* is associated with a current-limiting resistor 542' and is connected to the terminals of the contact 58*b*. The detection circuit 54' also comprises a rectifier bridge circuit 543' having a pair of terminals of the primary winding 541'*a* of the current transformer 541' and a pair of terminals connected to a resistor 544' which generates a zero phase detection $S_1'$ which is similar to the signal $S_1$ of FIG. 3. Thus, the operation of the circuit of FIG. 5 is the same as that of the circuit of FIG. 3**.

Figure 6:
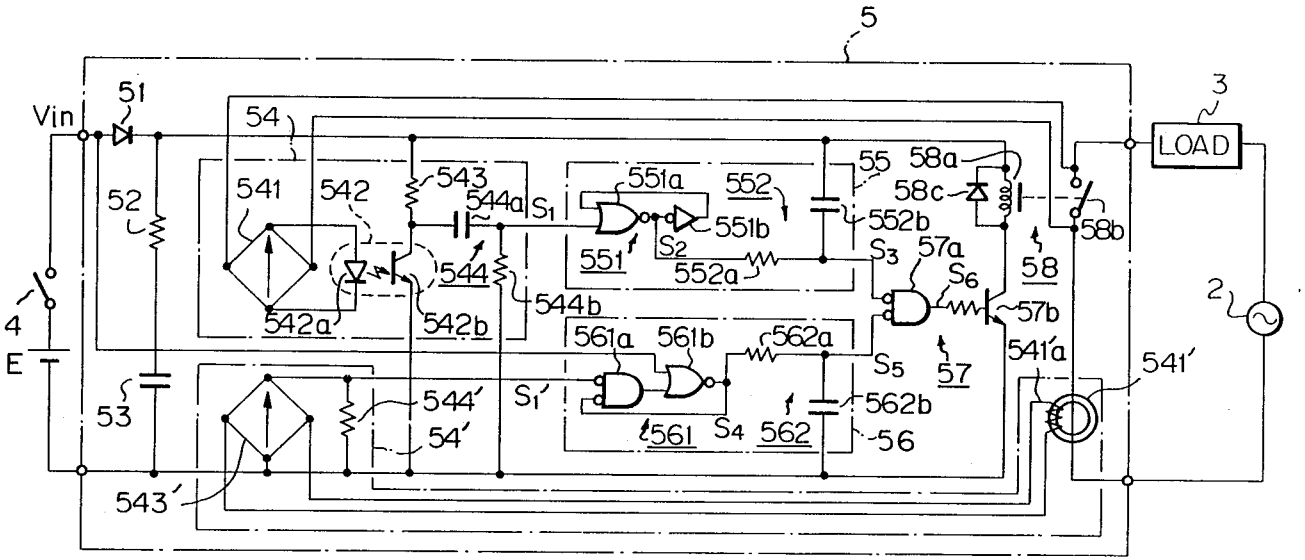

In FIG. 6, which illustrates a third embodiment of the present invention, there are two detection circuits. That is, the detection circuit 54 is provided only for the closing timing control circuit 55, and the detection circuit 54' is provided only for the opening timing control circuit 56. In this case, the detection circuit 54' does not include the secondary winding **541'*b* and the current-limiting resistor 542' as shown in FIG. 5, since in this case, a closed loop formed by the AC power supply 2, the load 3, the rectifier bridge circuit 541, and the current transformer 541' is always present. The operation of the circuit of FIG. 6 is also the same as that of the circuits of FIGS. 3 or 5**.

Figure 7:
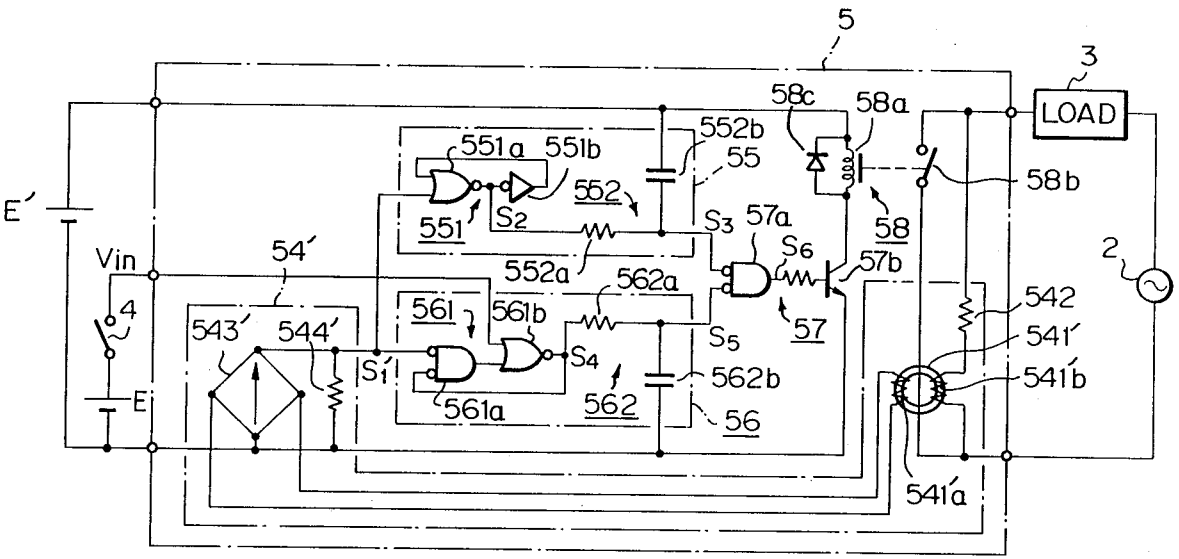

In FIG. 7, which illustrates a fourth embodiment of the present invention, a DC power supply E' is added to the circuit of FIG. 5. The DC power supply E' always activates each portion of the hybrid relay circuit 5, and therefore, the diode 51, the resistor 52, and the capacitor 53 of FIG. 6 are unnecessary. In this case, the input voltage $V_{in}$ generated by the switch 4 is used only for disabling the hold circuit 561 of the opening timing control circuit 56. The operation of the circuit of FIG. 7 is also the same as that of the circuits of FIGS. 3, 5, or 6.

Figure 8:
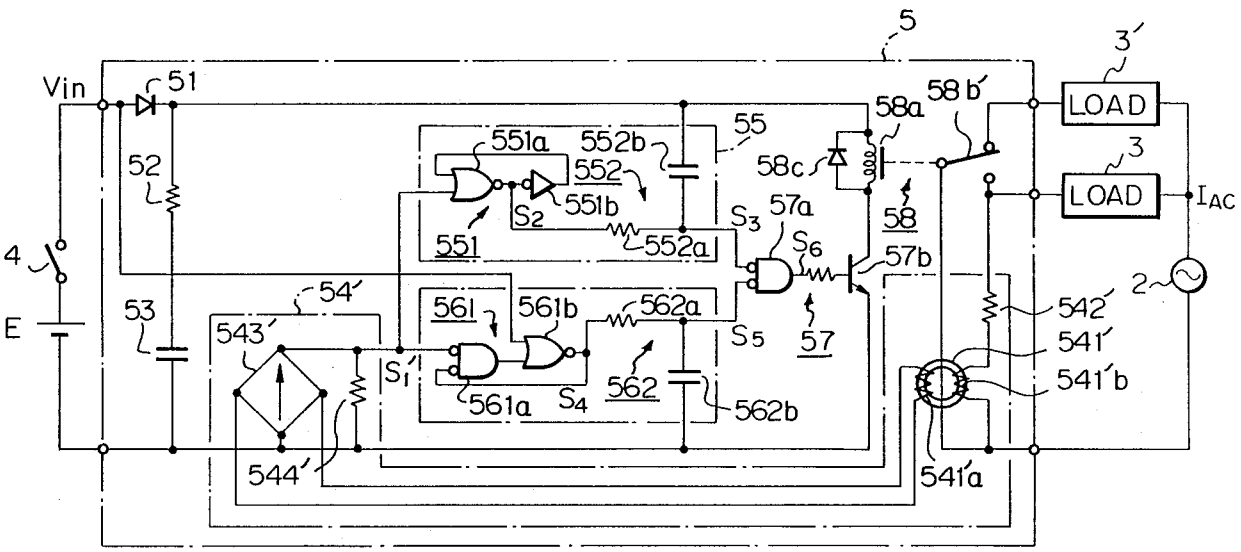

In FIG. 8, which illustrates a fifth embodiment of the present invention, a load 3' is added to the circuit of FIG. 5, and the electromagnetic relay 58 comprises a transfer contact **58*b'* instead of the make contact 58*b*. For example, in the case of a road pedestrian crossing signal, the load 3 is a red lamp and the load 3' is a blue lamp. Therefore, when the switch 4 is turned ON to operate the closing timing control circuit 55, the contact 58***b*′ of the electromagnetic relay 58 is moved down, thereby supplying a large amount of current to the load 3. Contrary to this, when the switch 4 is turned OFF to operate the opening timing control circuit 56, the contact 58*b*′ of the electromagnetic relay 58 is moved up, thereby supplying a large amount of current to the load 3′. Thus, a plurality of leads can be controlled without increasing the number of electromagnetic relays.

As explained hereinbefore, according to the present invention, the circuit for switching an AC power supply applied to a load or loads can be reduced in size and in cost, as compared with conventional solid state relay circuits. Also, the circuit according to the present invention can ensure reliable operation, since it is resistant to surge voltage. Further, the circuit according to the present invention generates little noise, and accordingly, circuits other than the hybrid relay circuit may be reliably operated.

We claim:

1. A hybrid relay circuit for supplying current to a load with a AC power supply in accordance with an input signal, comprising:

an electromagnetic relay having a contact connected in series to said load and said AC power supply;

a driving circuit, connected to said electromagnetic relay, for driving said electromagnetic relay in accordance with said input control signal;

a detection circuit, connected to said AC power supply, for detecting whether the potential of said AC power supply is zero, said detection circuit comprising a rectifier bridge circuit having two pairs of diagonal terminals, one pair of said diagonal terminals being connected to the terminals of said AC power supply, a photocoupler connected to the other pair of diagonal terminals, and a differential circuit linked between said photocoupler and said driving circuit;

an opening timing control circuit linked between said detection circuit and said driving circuit, for turning ON said driving circuit after receiving said input control signal which is turned OFF, so that said contact is opened when the potential of said AC power supply becomes approximately zero wherein said opening timing control circuit comprises a first hold circuit, connected to said detection circuit, for holding the output of said detection circuit after said detection circuit detects that the potential of said AC power supply is zero, and a first integration circuit, linked between said first hold circuit and said driving circuit, for delaying the output of said first hold circuit, thereby turning OFF said driving circuit, said first hold circuit being operated when said input control signal is turned OFF; and a DC buffer for receiving said input control signal and applying a DC voltage to said first hold circuit and to said electromagnetic relay.

2. A circuit as set forth above in claim 1, further comprising a closing timing control circuit, linked between said detection circuit and said driving circuit, for turning ON said driving circuit after receiving said input control signal which is turned ON, so that said contact is closed when the potential of said AC power supply becomes approximately zero.

3. A circuit as set forth in claim 2, wherein said closing timing control circuit comprises:

a second circuit, connected to said detection circuit, for holding the output of said detection circuit after said detection circuit detects that the potential of said AC power supply is zero; and a second integration circuit, linked between said second hold circuit and said driving circuit, for delaying the output of said second hold circuit, thereby turning ON said driving circuit, said second holding circuit being operated when said input control signal is turned ON.

4. A circuit as set forth in claim 3, wherein said DC buffer applies said DC voltage to said second hold circuit, and to said second integration circuit.

5. A circuit as set forth in claim 1, wherein said contact is a make contact.

6. A circuit as set forth in claim 1, wherein said contact is a transfer contact therein switching the connection of a plurality of loads to said AC power supply in accordance with said input control signal.

7. A hybrid relay circuit for supplying current to a load with a AC power supply in accordance with an input signal, comprising:

an electromagnetic relay having a contact connected in series to said load and said AC power supply;

a driving circuit, connected to said electromagnetic relay, for driving said electromagnetic relay in accordance with said input control signal;

a detection circuit, connected to said AC power supply, for detecting whether the potential of said AC power supply is zero, said detection circuit comprising a rectifier bridge circuit having two pairs of diagonal terminals, one pair of said diagonal terminals being connected to the terminals of said AC power supply, a photocoupler connected to the other pair of diagonal terminals, and a differential circuit linked between said photocoupler and said driving circuit;

a closing timing control circuit, connected to said driving circuit, for turning ON said driving circuit after receiving said input control signal which is turned ON, so that said contact is closed when the potential of said AC power supply becomes approximately zero; and an opening timing control circuit, connected to said driving circuit, for turning ON said driving circuit after receiving said input control signal which is turned OFF, so that said contact is opened when the potential of AC power supply becomes approximately zero.

8. A circuit as set forth in claim 7, further comprising a common detection circuit for said closing timing control circuit and said opening timing control circuit, said common detection circuit detecting whether the potential of said AC power supply is zero.

9. A circuit as set forth in claim 8, wherein said common detection circuit comprises:

a rectifier bridge circuit having two pairs of diagonal terminals, one pair of said diagonal terminals being connected to said contact;

a photocoupler connected to the other pair of diagonal terminals; and a differential circuit linked between said photocoupler and a hold circuit.

10. A circuit as set forth in claim 8, wherein said common detection circuit comprises:

a current transformer connected to said AC power supply, said current transformer having first and second windings;

a current limiting resistor associated with said second winding of said current transformer, linked between the terminals of said contact;

a rectifier bridge circuit having two pairs of diagonal terminals, one pair of said diagonal terminals being connected to said first winding of said current transformer; and a resistor connected to the other pair of diagonal terminals of said rectifier bridge circuit.

11. A circuit as set forth in claim 8, wherein each of said closing and opening timing control circuits comprises:

a hold circuit, connected to said common detection circuit, for holding the output of said common detection circuit after said common detection circuit detects that the potential of said AC power supply is zero; and an integration circuit, connected to said hold circuit and said driving circuit, for delaying the output of said hold circuit;

said integration circuit of said closing timing control circuit being operated when said input control signal is turned ON, said hold circuit of said opening timing control circuit being operated when said input control signal is turned OFF.

12. A hybrid relay circuit for supplying current to a load with a AC power supply in accordance with an input control signal, comprising:

an electromagnetic relay having a contact connected in series to said load and said AC power supply;

a driving circuit, connected to said electromagnetic relay, for driving said electromagnetic relay in accordance with said input control signal; and a detection circuit, connected to said AC power supply, for detecting whether the potential of said AC power supply is zero, said detection circuit comprising a current transformer connected to said AC power supply, said current transformer having first and second windings, a current limiting resistor associated with said second winding of said current transformer, linked between the terminals of said contact, a rectifier bridge circuit having two pairs of diagonal terminals, one pair of said diagonal terminals being connected to said first winding of said current transformer, and a resistor connected to the other pair of diagonal terminals of said rectifier bridge circuits;

an opening timing control circuit linked between said detection circuit and said driving circuit, for turning ON said driving circuit after receiving said input control signal which is turned OFF, so that said contact is opened when the potential of said AC power supply becomes aproximately zero wherein said opening timing control circuit comprises a first hold circuit, connected to said detection circuit, for holding the output of said detection circuit after said detection circuit detects that the potential of said AC power supply is zero, and a first integration circuit, linked between said first hold circuit and said driving circuit, for delaying the output of said first hold circuit, thereby turning OFF said driving circuit, said first hold circuit being operated when said input control signal is turned OFF a DC buffer for receiving said input control signal and applying a DC voltage to said first hold circuit and to said electromagnetic relay.

13. A circuit as set forth above in claim 12, further comprising a closing timing control circuit, linked between said detection circuit and said driving circuit, for turning ON said driving circuit after receiving said input control signal which is turned ON, so that said contact is closed when the potential of said AC power supply becomes approximately zero.

14. A circuit as set forth in claim 13, wherein said closing timing control circuit comprises:

a second hold circuit, connected to said detection circuit, for holding the output of said detection circuit after said detection circuit detects that the potential of said AC power supply is zero; and a second integration circuit, linked between said second hold circuit and said driving circuit, for delaying the output of said second hold circuit, thereby turning ON said driving circuit, said second holding circuit being operated when said input control signal is turned ON.

15. A circuit as set forth in claim 14, wherein said DC buffer applies said DC voltage to said second hold circuit, and to said second integration circuit.

16. A circuit as set forth in claim 12, wherein said contact is a make contact.

17. A circuit as set forth in claim 12, wherein said contact is a transfer contact therein switching the connection of a plurality of loads to said AC power supply in accordance with said input control signal.

18. A hybrid relay circuit for supplying current to a load with a AC power supply in accordance with an input control signal, comprising:

an electromagnetic relay having a contact connected in series to said load and said AC power supply;

a driving circuit, connected to said electromagnetic relay, for driving said electromagnetic relay in accordance with said input control signal;

a detection circuit, connected to said AC power supply, for detecting whether the potential of said AC power supply is zero, said detection circuit comprising a current transformer connected to said AC power supply, said current transformer having first and second windings, a current limiting resistor associated with said second winding of said current transformer, linked between the terminals of said contact, a rectifier bridge circuit having two pairs of diagonal terminals, one pair of said diagonal terminals being connected to said first winding of said current transformer, and a resistor connected to the other pair of diagonal terminals of said rectifier bridge circuits;

a closing timing control circuit, connected to said driving circuit, for turning ON said driving circuit after receiving said input control signal which is turned ON, so that said contact is closed when the potential of said AC power supply becomes approximately zero; and an opening timing control circuit, connected to said driving circuit, for turning ON said driving circuit after receiving said input control signal which is turned OFF, so that said contact is opened when the potential of AC power supply becomes approximately zero.

19. A circuit as set forth in claim 18, further comprising a common detection circuit for said closing timing control circuit and said opening timing control circuit, said common detection circuit detecting whether the potential of said AC power supply is zero.

20. A circuit as set forth in claim 19, wherein said common detection circuit comprises:

a rectifier bridge circuit having two pairs of diagonal terminals, one pair of said diagonal terminals being connected to said contact;

a photocoupler connected to the other pair of diagonal terminals; and a differential circuit linked between said photocoupler and a hold circuit.

21. A circuit as set forth in claim 19, wherein said common detection circuit comprises:

a current transformer connected to said AC power supply, said current transformer having first and second windings;

a current limiting resistor associated with said second winding of said current transformer, linked between the terminals of said contact;

a rectifier bridge circuit having two pairs of diagonal terminals, one pair of said diagonal terminals being connected to said first windings of said current transformer; and a resistor connected to the other pair of diagonal terminals of said rectifier bridge circuit.

22. A circuit as set forth in claim 19, wherein each of said closing and opening timing control circuits comprises:

a hold circuit, connected to said common detection circuit, for holding the output of said common detection circuit after said common detection circuit detects that the potential of said AC power supply is zero; and an integration circuit, connected to said hold circuit and said driving circuit, for delaying the output of said hold circuit;

said integration circuit of said closing timing control circuit being operated when said input control signal is turned ON, said hold circuit of said opening timing control circuit being operated when said input control signal is turned OFF.

* * * * *